US008459076B2

(12) United States Patent
Flehmig et al.

(10) Patent No.: US 8,459,076 B2
(45) Date of Patent: Jun. 11, 2013

(54) METHOD AND DEVICE FOR PRODUCING CLOSED PROFILES

(75) Inventors: Thomas Flehmig, Ratingen (DE); Michael Brüggenbrock, Rosendahl (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 419 days.

(21) Appl. No.: 12/729,951

(22) Filed: Mar. 23, 2010

(65) Prior Publication Data

US 2010/0242565 A1 Sep. 30, 2010

(30) Foreign Application Priority Data

Mar. 24, 2009 (DE) ..... 10 2009 003 668

(51) Int. Cl.
*B21D 19/12* (2006.01)

(52) U.S. Cl.
USPC ..... 72/48; 72/51; 72/380; 72/381

(58) Field of Classification Search
USPC ..... 72/48, 51, 380, 381, 383, 384, 389.1, 72/347, 348
See application file for complete search history.

(56) References Cited

U.S. PATENT DOCUMENTS

| | | | | |
|---|---|---|---|---|
| 6,601,427 | B2 * | 8/2003 | Kondou et al. | 72/368 |
| 7,337,645 | B2 * | 3/2008 | Davis et al. | 72/348 |
| 7,637,135 | B2 * | 12/2009 | Homig et al. | 72/368 |
| 2004/0035166 | A1 * | 2/2004 | Maeda et al. | 72/48 |
| 2010/0193064 | A1 * | 8/2010 | Takada | 138/156 |
| 2010/0251795 | A1 * | 10/2010 | Bruggenbrock et al. | 72/325 |

FOREIGN PATENT DOCUMENTS

| | | |
|---|---|---|
| DE | 8536655 | 4/1986 |
| DE | 102007021798 | 11/2008 |
| JP | 05-123741 | 5/1993 |

* cited by examiner

*Primary Examiner* — Dana Ross
*Assistant Examiner* — Homer Boyer
(74) *Attorney, Agent, or Firm* — Proskauer Rose LLP

(57) ABSTRACT

A device for producing at least partly closed profiles from a blank includes at least one first die and at least one second die which can be positioned opposite the first die. The first die has a cavity and two side walls, wherein the side walls and the cavity of the first die can be raised and lowered relative to one another. A U-punch is provided to produce a U-shaped cross-sectional shape of the blank with the first die. The second die of the device has a cavity for producing an at least partly closed cross-sectional shape from a U-shaped blank. The device also has at least one supporting core. The cavity of the second die has elongated side walls in the direction of the first die, with which, the side walls of the first die can be lowered relative to the cavity of the first die.

7 Claims, 7 Drawing Sheets

METHOD AND DEVICE FOR PRODUCING CLOSED PROFILES

CROSS-REFERENCE TO RELATED APPLICATION

This application claims the benefit of and priority to German patent application no. DE 10 2009 003 668.7-14, filed on Mar. 24, 2009. The disclosure of the above application is incorporated herein by reference in its entirety.

FIELD OF THE INVENTION

The invention relates to a device for producing at least partly closed profiles or semi-finished products from a blank comprising at least one first die and at least one second die which can be positioned opposite the first die. In addition, the invention relates to a method for producing an at least partly closed profile or semi-finished product.

BACKGROUND

Continuous or discontinuous methods can be used for producing at least partly closed profiles or semi-finished products. Discontinuous methods are appropriate when a continuous production method cannot be used due to the complex forming operation. For example, the curling method and the U-O forming method are known for discontinuous production of at least partly closed profiles or semi-finished products. The curling method, and also the previously known U-O forming method, both require relatively long cycle times to produce the closed profile. At the same time, special presses must often be provided to carry out the method, as different supporting movements in different directions, for example moving the blanks from one die into another one, are often necessary for production. These supporting movements not only cost additional cycle time, but also create increased costs. This also, of course, applies for the use of special presses for producing at least partly closed profiles or semi-finished products.

SUMMARY OF THE INVENTION

In general, an aspect forming a basis of the present invention is to provide a device and a method for producing at least partly closed profiles, with which it is possible to produce at least partly closed profiles or semi-finished products from a flat blank with low cycle times and using standardised machines, for example standard presses or transfer presses.

According to a first teaching of the present invention, the above disclosed aspect for a generic device is achieved by the first die having a cavity and two side walls, wherein the side walls of the first die and the cavity of the first die can be raised and lowered relative to one another, wherein a U-punch is provided to produce a U-shaped cross-sectional shape of the blank with the first die, the second die having a cavity for producing an at least partly closed cross-sectional shape from a U-shaped blank, at least one supporting core with means for positioning the supporting core in a U-shaped blank being provided, the cavity of the second die having elongated side walls in the direction of the first die, with which, when the at least partly closed cross-sectional shape of the blank is produced, the side walls of the first die can be lowered relative to the cavity of the first die.

It has been shown that when producing at least partly closed profiles from a flat blank, the use of a die with side walls, which can be raised or lowered relative to cavity of the die, is advantageous, as by this means supporting movements, for example moving the blank out of the die to carry out O-forming after U-forming, are no longer necessary. This reduces not only the cycle time, but also results in standardised presses having, for example, only one movement axis for forming a blank to an at least partly closed cross-sectional shape, being suitable, as complex supporting movements are no longer necessary.

According to another embodiment of the present invention, holding-down devices are provided for forming the blank into a U-shape with the U-punch, which secure the blank during U-forming. By this means, the blank is pre-formed in a controlled manner without the cycle time being increased.

If the side walls and/or the cavity of the first die can be raised and lowered in a controlled manner, for example hydraulically or pneumatically, the movements of the side walls and the cavity of the first die against each other can be controlled in a simple way by customarily used hydraulic or pneumatic presses. It is also possible, however, to effect the movement of the side walls and/or the cavity of the first die, for example, by servo-electric motors.

Preferably, the U-punch, the second die and optionally the holding-down devices are arranged on a cross-slide which is free to move transverse to the axial extent of the profile to be produced and which cross-slide is arranged so that it can move on a tool holder plate. In this case, at least partly closed hollow profiles can be produced using particularly simple presses having only one direction of movement.

The same applies if, alternatively, the first die is arranged on a cross-slide which is free to move transverse to the axial extent of the profile to be produced and which cross-slide is arranged so that it can move on a tool holder plate. In this case, the first die can be moved relative to the second die and the device according to the invention can likewise be used in simple presses. If both the U-punch, the second die and optionally the holding-down devices are arranged on a first cross-slide and the first die is arranged on a second cross-slide, wherein the cross-slides are both respectively arranged so that they can move on tool holder plates, the cycle times can be further reduced by reducing the distances traveled by the cross-slides.

In addition, in another embodiment, means can be provided for effecting a movement of the supporting core in the direction of the second die, so that the supporting core, inserted into the U-shaped blank, can be easily lifted and, on the one hand, can support the legs of the U-shaped blank and, on the other hand, can effectively prevent wrinkle formation when the closed cross-sectional shape of the profile is produced.

In order to facilitate immersion of the U-shaped blank into the second die, with which the U-shape is formed into a closed cross-sectional shape, according to another embodiment the second die has entry curves on the side walls.

According to the present invention, the above disclosed aspect is also achieved for a generic method using a device according to the invention, in which

- blank is placed on the upward facing edges of the side walls of a first die,
- a U-punch is driven into a cavity of the first die and the blank is pre-formed,
- the blank is formed into an at least partly U-shaped cross-sectional shape by a movement of the side walls of the first die relative to the cavity of the first die, wherein the U-punch remains positioned in the cavity during the relative movement,
- the U-punch is removed from the blank formed into a U-shape, a supporting core is inserted into the blank formed into a U-shape, a second die is positioned opposite the first die and by means of the side walls of the second die, which side walls rest on the side walls of the first die, the side walls of the first die are moved relative to the cavity of the first die, so that the U-shaped blank is formed into a blank having a partly closed cross-sectional shape.

In the method according to the invention, the blank, which is flat at the outset, therefore remains in the first die and does not have to be placed into another die by supporting movements—which would have to be carried out by cost-intensive handling systems—in order to complete the forming. In addition, the forming movement only takes place by means of a relative movement between cavity of the first die and the second die. Thus, a normal pressing movement. This considerably reduces the cycle time of the method according to the invention because re-positioning of the blank, for example in a second device, is avoided. Therefore, to complete forming to a partly closed cross-sectional shape, only two movements are necessary. On the one hand, the movement of the second die, so that this is positioned opposite the first die, and, on the other hand, a relative movement between U-punch, in which the U-punch is either driven into the cavity of the first die or an at least partly closed cross-sectional shape is produced from the U-shaped blank by means of the second die. Very, very few movements are, therefore, necessary, wherein the positioning of the U-punch over the cavity of the first die and the positioning of the second die opposite the first die can be put into effect, so that the press used, in which the method according to the invention is carried out, only has to have one direction of movement. The other movements of the device can, for example, be easily put into effect by positive guides or by additional drive mechanisms within the device according to the invention, for example in a transfer press.

According to a first embodiment of the method according to the invention, the first die is raised, together with the supporting core placed into the U-shaped blank, in the direction of the second die to produce the partly closed cross-sectional shape of the profile, wherein the position of the side walls of the first die is moved to the cavity of the first die by the side walls of the second die and the U-shaped blank is formed into an at least partly closed cross-sectional shape. Alternatively, this can also be carried out by lowering the second die onto the first die, wherein by lowering the second die onto the first die the supporting core is lowered simultaneously with the second die and a defined gap remains between supporting core and second die, which gap is greater than the thickness of the blank to be formed and enables targeted curling of the edges of the blank into the gap, wherein the material is curled essentially free of wrinkles.

The forming process can be particularly controlled if holding-down devices are used when the U-punch pre-forms the blank into the U-shaped blank.

According to a refined embodiment of the method according to the invention, after removing the U-punch from the U-shaped blank, the U-punch with the second die and the first die are moved relative to one another transverse to the axial extent of the blank formed into a U-shape, so that the replacement of the U-punch, which is arranged over the first die, with the second die can take place over short distances and the cycle time for completing the forming can be reduced further.

Preferably, at least one cross-slide, arranged so that it can move on a tool holder plate, is used for the relative movement between first die, U-punch and second die. The cross-slide enables a movement to be carried out in a simple way which is aligned, for example, perpendicular to the closing movement of the press used. If two cross-slides are used, one for the first die and another for the U-stamp and the second die, the distances to be covered for positioning the second die and the U-stamp opposite the first die can be minimised, for example halved, by a movement of both cross-slides in opposite directions. Moreover, the cross-slide in conjunction with a tool holder plate enables the tool to be used easily in any presses allowing only a closing movement. Hereby, the costs for carrying out the method can also be further reduced with extremely low cycle times and manufacturing times.

A further reduction of the cycle times for producing an at least partly closed profile is achieved according to a subsequent embodiment of the method according to the invention, by the supporting core, when the U-punch and the second die are moved relative to the first die, being inserted into the U-shaped blank. Therefore, a device idle time for inserting the supporting core is utilised, which results in reduced manufacturing and cycle times.

The formation of wrinkles during forming into an at least partly closed cross-sectional shape is achieved according to a further embodiment of the method according to the invention by the supporting core being positioned in a raised position in the U-shaped blank. The legs of the blank formed into a U-shape are hereby also supported.

A particularly simple possibility for removing the finished, at least partly closed profile is achieved by the cavity of the first die being raised by means of at least one spindle for removing the produced, at least partly closed profile. The finished, at least partly closed profile can hereby be positioned so that it is free for a removing tool.

Finally, the method according to the invention can be still further advantageously developed by, in forming the U-shaped blank into an at least partly closed cross-sectional shape, the profile produced being directly calibrated with the device. For example, this can be achieved via the length of the legs of the blank formed into a U-shape, by these being selected bigger, as is, in fact, required for producing the closed cross-sectional shape of the profile. Thus, when the U-shaped blank is formed into an at least partly closed cross-sectional shape, the produced, closed profile is compressed in the end positions of the first and second dies in relation to one another, which results in calibration, so that particularly true-to-shape, closed hollow profiles can be produced. Preferably, the edge joint produced is so precise that this can be laser welded.

BRIEF DESCRIPTION OF THE DRAWINGS

There is now a plurality of possible embodiments of the device according to the invention and the method according to the invention for producing an at least partly closed profile. Reference is made, in this regard, to the description of an exemplary embodiment of a device and method according to the invention in conjunction with the drawing. The drawing shows in.

DESCRIPTION

Figure 1:
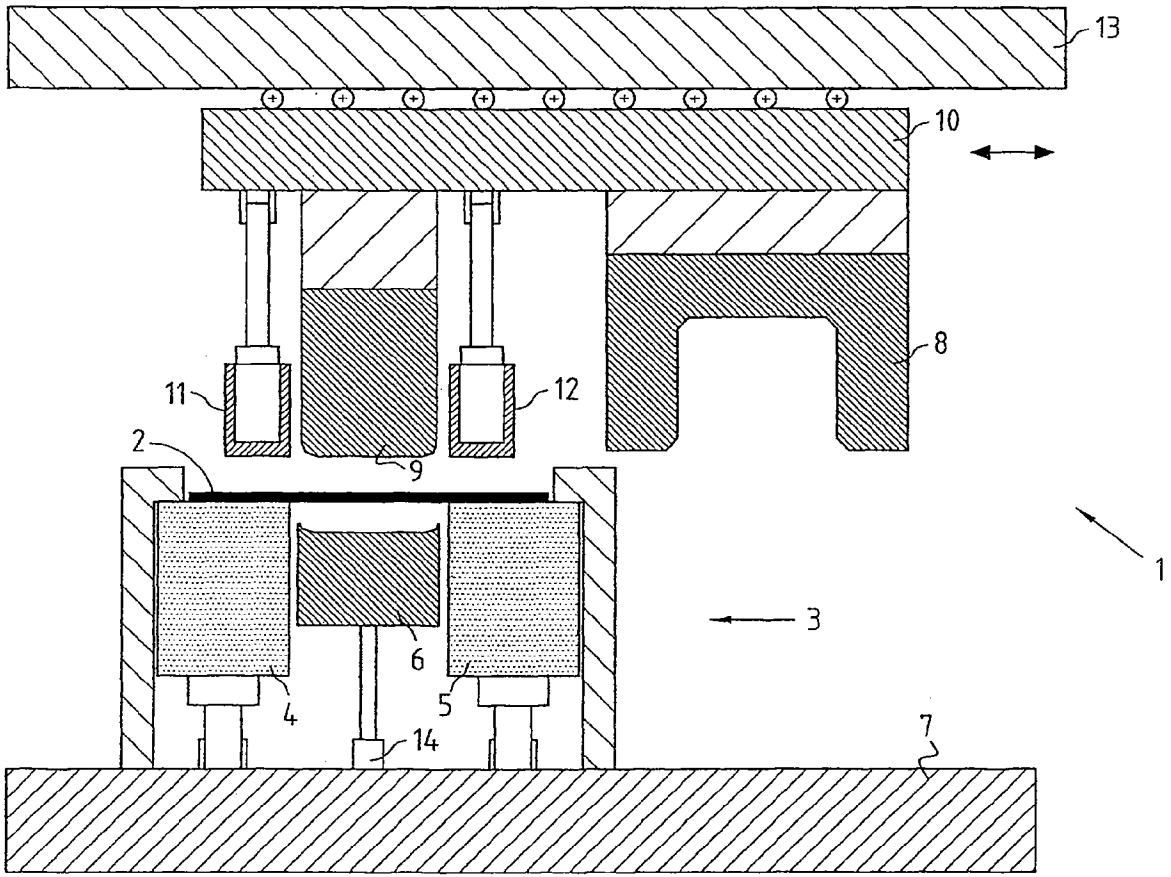
FIGS. 1 to 5 an exemplary embodiment of a device according to the invention during four different points in time when putting an exemplary embodiment of the method according to the invention into practice and in FIGS. 6 and 7 a second and third exemplary embodiment of a device according to the invention.

FIG. 1 first shows the exemplary embodiment of a device 1 according to the invention for producing at least partly closed profiles or semi-finished products from a blank 2 after the blank 2 has been inserted in the open state. The device 1 has a first die 3 which consists of two side walls 4, 5 and a cavity 6. The first die 3 is firmly arranged on a tool holder plate 7. The second die 8 which can be positioned opposite the first die 3 is arranged together with a U-punch 9 on a common cross-slide 10. In addition, holding-down devices 11 and 12 are also provided which are arranged adjacent to the U-punch 9. The cross-slide 10 is arranged so that it can move opposite to another tool holder plate 13, so that by a movement of the cross-slide 10 both the U-punch 9 and the second die 8 can be arranged opposite the first die 3. The device 1 is arranged in a press which is not illustrated and which by means of a closing movement can move the tool holder plates 7 and 13 towards one another. Moreover, the press can also move both tool holder plates 7, 13 away from one another again by means of an opening movement. The tool holder plates therefore act as adapters, so that the device 1 according to the invention can be used on different presses.

In FIG. 1, the device 1 is illustrated in the opened position. The blank 2, which is initially flat, rests on the side walls 4, 5 of the first die 3 and the U-punch is positioned opposite the first die 3. This is, as it were, the starting point for the forming process.

Further forming operations, not illustrated here, can be carried out on the semi-finished product or at least partly closed profile by the device. Such forming operations are additional functions, like for example, cutting and/or hole punching operations, which can be formed via appropriate means, not illustrated here, using the U-punch, supporting core, side walls, die or a combination thereof. An additional design can provide a movement of the side walls in opposite directions (not illustrated here) to enable a produced semi-finished product to be removed with forming (auxiliary-forming) elements.

Figure 2:
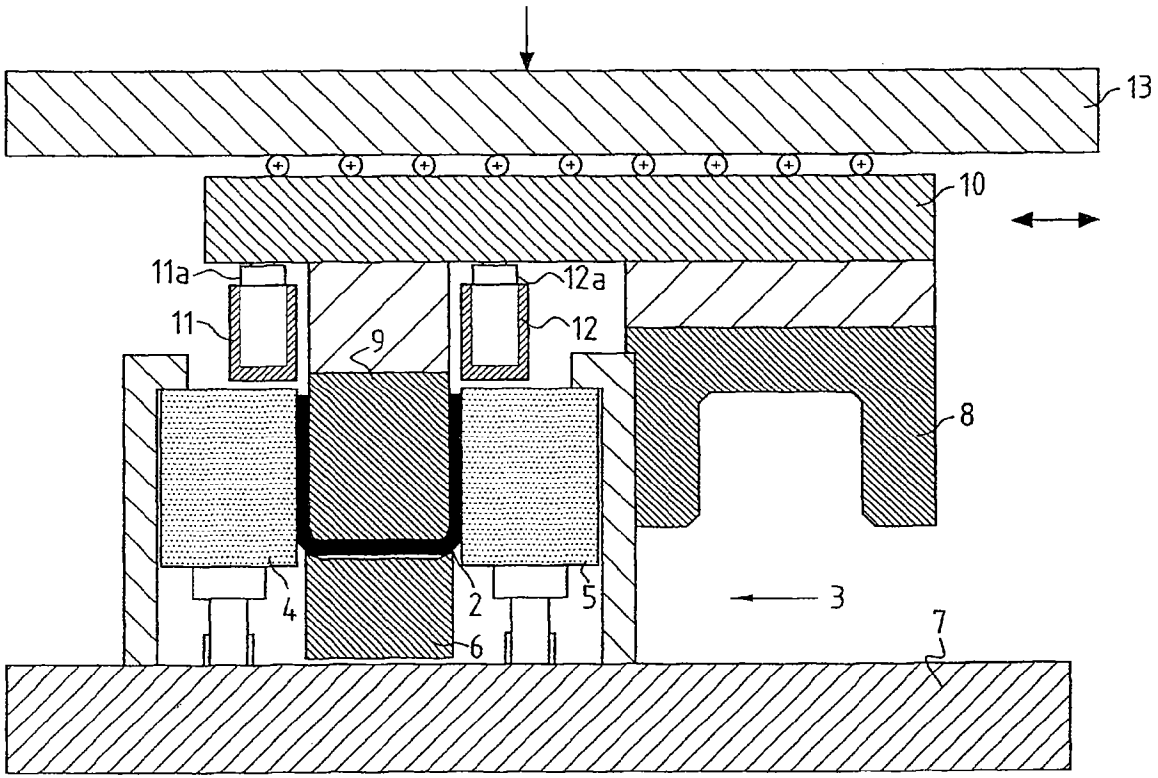

As illustrated in FIG. 2, the device 1 is now closed by the press, which is not illustrated, and the two tool holder plates 13 and 7 are moved towards one another, so that the U-punch 9 is immersed into the cavity 6. The blank 2 is formed into a U-shaped blank 2 by a relative movement of the cavity 6 opposite the side walls 4 and 5 of the first die 3. In the present exemplary embodiment, the cavity 6 is lowered opposite the side walls 4, 5. However, it is also conceivable for an opposite relative movement to be carried out.

The holding-down devices 11 and 12, which are pressed onto the blank 2 by means of hydraulics or pneumatics 11*a*, 12*a*, lead to the blank being formed into a U-shaped blank 2 in a controlled manner. Spindles 14, not illustrated in FIG. 2, on which the cavity 6 of the first die 3 is supported, produce the necessary counter-pressure against the U-punch 9 during forming, in order to provide sufficient and precise shaping from the cavity 6.

Figure 3:
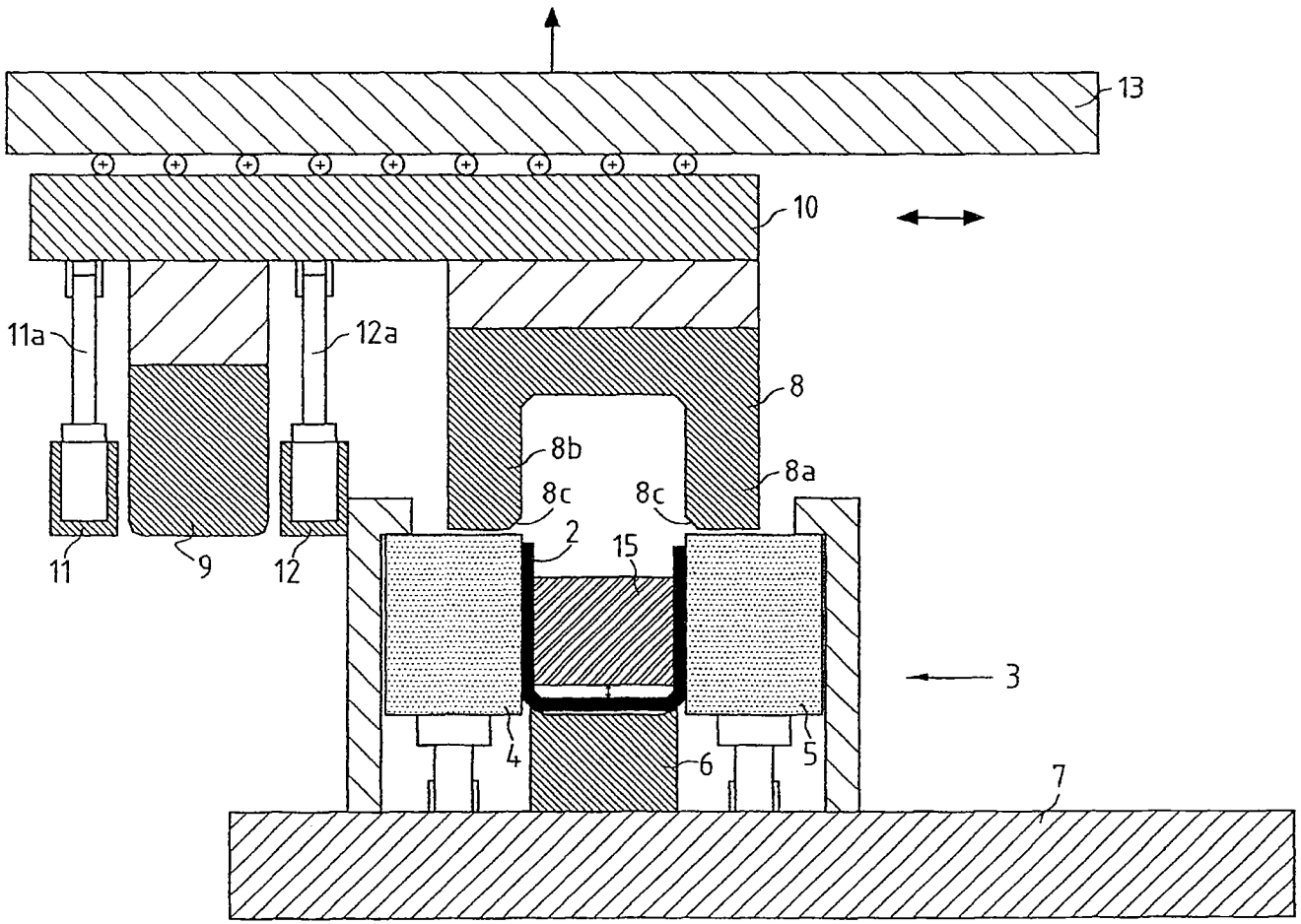
Figure 4:
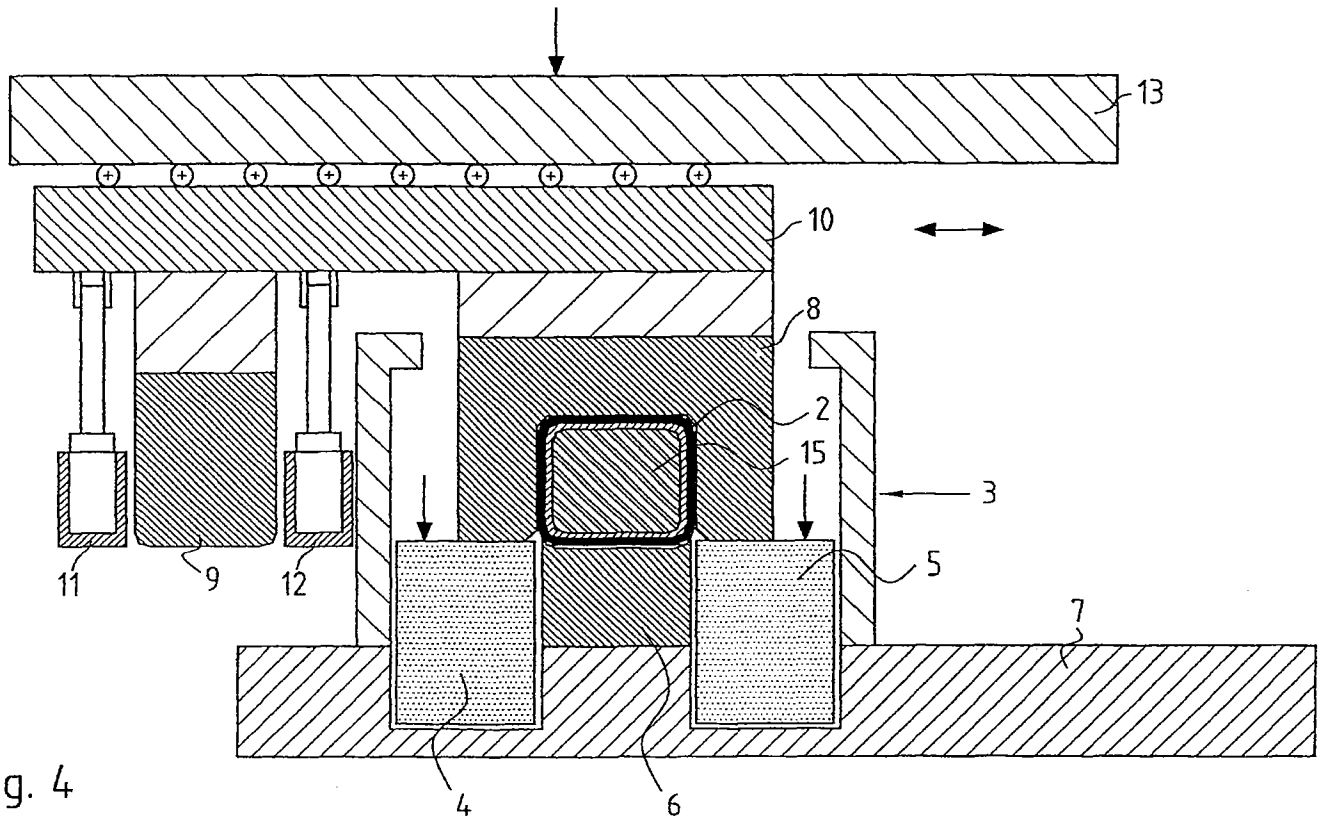

After the forming step, the U-punch 9 is driven out of the blank 2 formed into a U-shape by an opening movement of the press, so that the cross-slide 10 can position the second die 8 opposite the first die 3 by a sideward movement. In order to reduce the cycle time, a supporting core 15 is inserted into the U-shaped blank during the positioning of the second die 8, which supporting core 15, as illustrated in FIG. 3, is positioned in an elevated position in the U-shaped blank 2, so that there is a distance to the base area of the formed blank 2. By inserting the supporting core 15 into the now U-shaped blank 2 at the same time as the second die is being positioned, the length of cycle for forming the blank 2 can be reduced. The second die 8 has elongated side walls 8*a*, 8*b* which also serve to change the position of the side walls 4, 5 of the first die 3 relative to the cavity 6. In order for the U-shaped blank 2 to be inserted into the second die 8 in a controlled manner, entry curves 8*c* are provided on the side walls 8*a*, 8*b*.

When the press closes again and the distance between the tool holder plates 7, 13 is decreased again, the second die 8, with side walls 8*a*, 8*b* resting on the side walls 4 and 5 of the first die, moves the position of the side walls 4 and 5 of the first die relative to the cavity 6 of the first die. The legs of the blank 2 formed into a U-shape are immersed into the second die 8 and are formed into an at least partially closed cross-sectional shape. In this process, the supporting core 15 serves to prevent any unwanted wrinkle formation. As illustrated in FIG. 2, the supporting core 15 has been positioned in an elevated position in the U-shaped blank, so that the process of forming the blank 2 into a closed cross-sectional shape is supported. For example, due to the elevated position of the supporting core 15, the legs of the U-shaped blank 2 can be supported and unwanted wrinkle formation can be counteracted during the forming. In the end position of the press, the closed profile 2 is also optionally calibrated in the present embodiment, as the dimensions of the blank 2, and thereby also of the legs of the blank 2 formed into a U-shape, are of a slightly greater length than is required for forming the closed hollow profile 2. The blank 2 is thus compressed during the closing process and is shaped with a high accuracy. In particular, a laser weldable edge joint of the opposite edges of the blank 2 can be easily produced by calibrating simultaneously.

Figure 5:
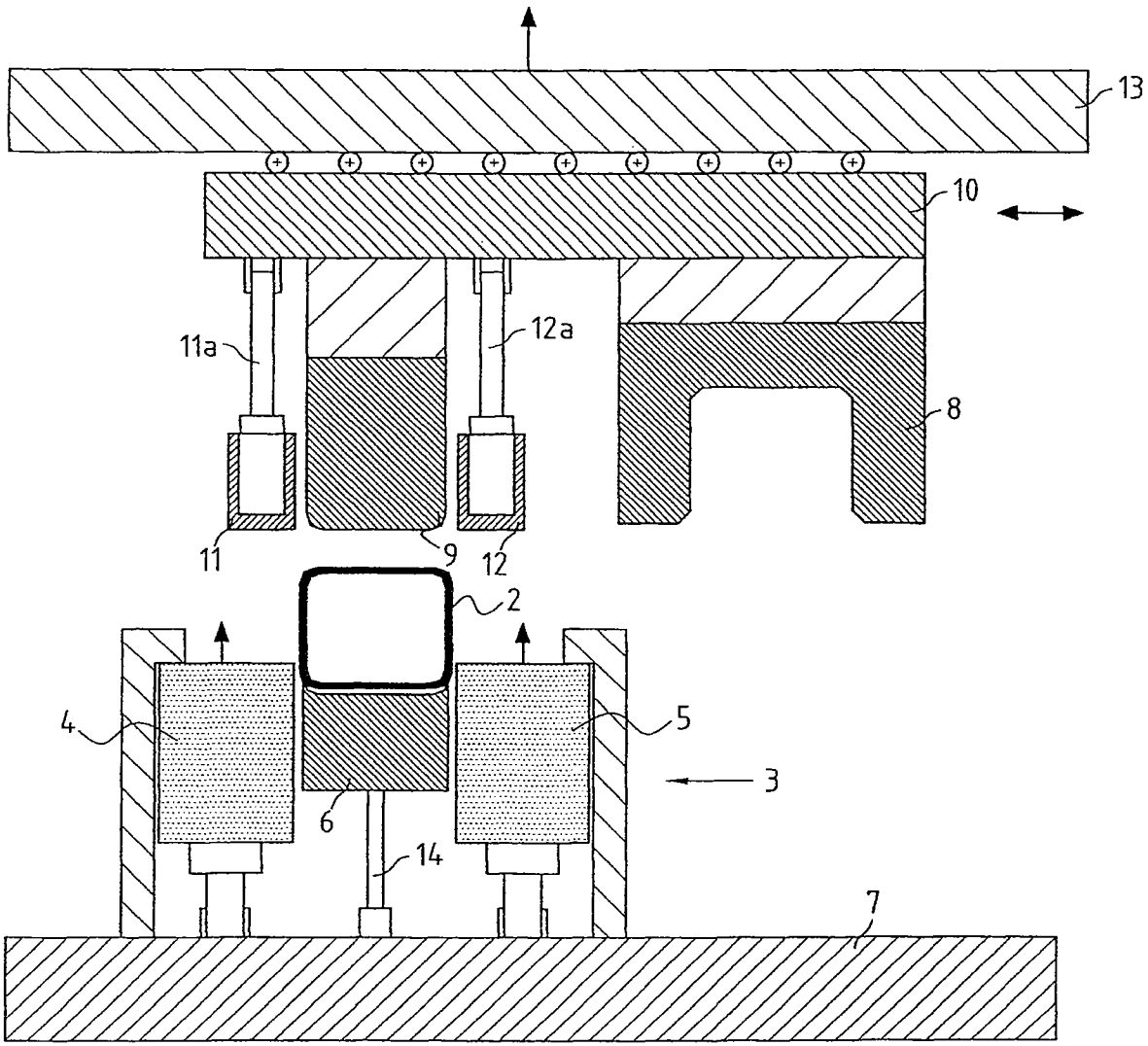

Afterwards, the supporting core 15 is pulled and the press opens again. When the tool holder plates 7 and 13 move away from each other again, the produced, at least partly closed profile or semi-finished product will, by means of moving the cavity 6 and the first die 3 via the spindle 14, be brought into a position in which it can be easily removed from the device 1 according to the invention. Furthermore, the side walls of the first die 3 are brought into the starting position for inserting the next blank 2, for example via hydraulics or pneumatics 4*a* and 5*a*. FIG. 5 shows this.

As can be seen from the description of FIGS. 1 to 5, the press (not illustrated) need only carry out opening and closing movements and each time needs two closing cycles for producing an at least partly closed profile 2. If calibration is used during the forming, the edges of the blank can be produced so accurately that the produced, closed profile 2 can be laser welded. Therefore, when using the device and the method according to the invention, a discontinuous method of production can be provided in an especially economically viable way, with which at least partly closed profiles or semi-finished products with a relatively complex shape can be produced from flat blanks, for example made of steel or a steel alloy. Due to the low cycle times and the low requirements for apparatus, for example for the press, the cost-effectiveness of this method is particularly high.

In order to provide a continuous method, the individual operations of the method according to the invention can be implemented in a transfer press (not illustrated).

Figure 6:
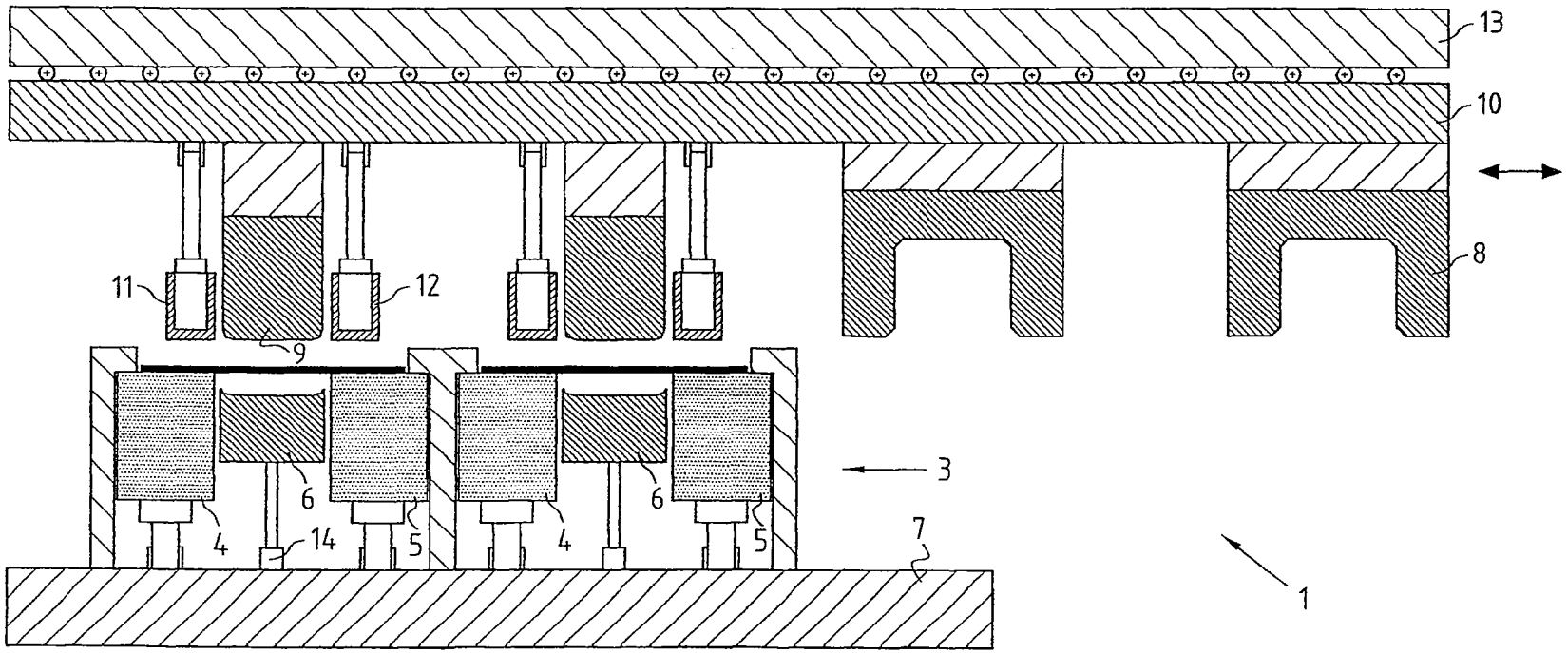
Figure 7:
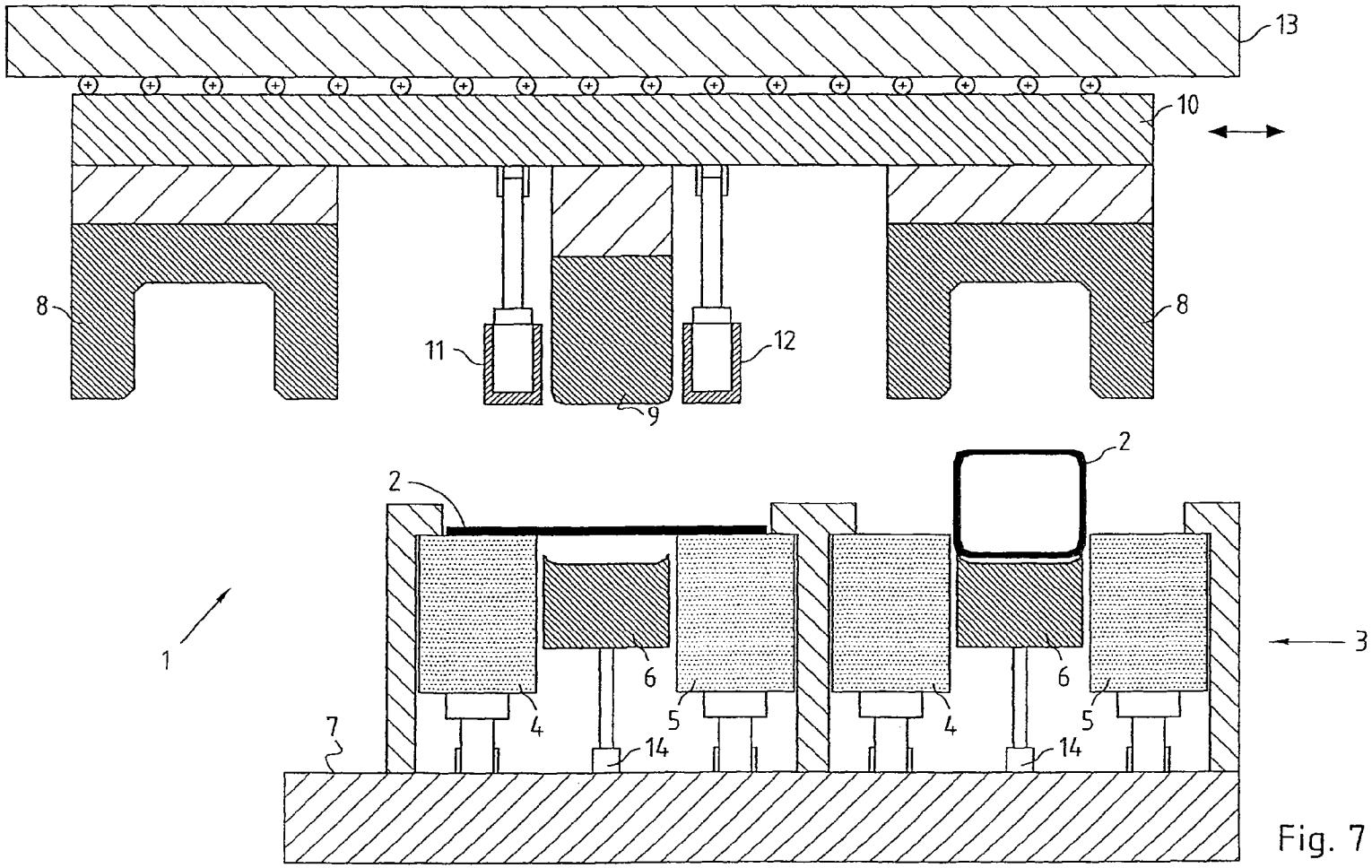

FIG. 6 and FIG. 7 show further possible embodiments of the device according to the invention. In order to increase the length of cycles in the discontinuous method of production, two blanks, for example, can at the same time be formed into a U-shaped semi-finished product and finally formed into a closed semi-finished product (FIG. 6) or at the same time a first blank can be formed into a U and a second U-shaped semi-finished product can be finally formed (FIG. 7).

The devices shown in FIG. 6 and FIG. 7 can also be provided in parallel or in series as often as is desired, in order to further increase the output.

What is claimed is:

1. Device for producing at least partly closed profiles or semi-finished products from a blank comprising at least one first die and at least one second die which can be positioned opposite the first die, wherein the at least one first die has a cavity and at least two side walls, wherein the at least two side walls of the at least one first die and the cavity of the at least one first die can be raised and lowered relative to one another, wherein a U-punch is provided to produce a U-shaped cross-sectional shape of the blank with the at least one first die, the at least one second die has a cavity for producing an at least partly closed cross-sectional shape from the U-shaped blank, at least one supporting core with means for positioning the supporting core in a U-shaped blank is provided, the cavity of the at least one second die has elongated side walls in the direction of the at least one first die, with which, when the at least partly closed cross-sectional shape of the blank is produced, the at least two side walls of the at least one first die can be lowered relative to the cavity of the at least one first die.

2. Device according to claim 1, wherein holding-down devices are provided for forming the blank into a U-shape with the U-punch.

3. Device according to claim 1, wherein the at least two side walls and/or the cavity of the at least one first die can be raised and lowered in a controlled manner.

4. Device according to claim 2, wherein, wherein the U-punch, the at least one second die and optionally the holding-down devices are arranged on a cross-slide which is free to move transverse to the axial extent of a profile to be produced and the cross-slide is arranged so that it can move on a tool holder plate.

5. Device according to claim 1, wherein, the at least one first die is arranged on a cross-slide which is free to move transverse to the axial extent of a profile to be produced and the cross-slide is arranged so that it can move on a tool holder plate.

6. Device according to claim 1, wherein means are provided for effecting a movement of a supporting core in the direction of the at least one second die.

7. Device according to claim 1, wherein the at least one second die has entry curves on the side walls.

* * * * *

UNITED STATES PATENT AND TRADEMARK OFFICE

CERTIFICATE OF CORRECTION

PATENT NO. : 8,459,076 B2
APPLICATION NO. : 12/729951
DATED : June 11, 2013
INVENTOR(S) : Thomas Flehmig et al.

It is certified that error appears in the above-identified patent and that said Letters Patent is hereby corrected as shown below:

In the Claims:

Claim 4, column 8, line 7, after "claim 2," delete "wherein,"

Signed and Sealed this
Sixth Day of August, 2013

Teresa Stanek Rea
*Acting Director of the United States Patent and Trademark Office*